US011653751B2

(12) United States Patent
Przirembel et al.

(10) Patent No.: US 11,653,751 B2
(45) Date of Patent: May 23, 2023

(54) LIQUID DISPENSING HAIR BRUSH

(71) Applicants: Scott Przirembel, Monterey, TN (US); Hans R. Przirembel, Monterey, TN (US)

(72) Inventors: Scott Przirembel, Monterey, TN (US); Hans R. Przirembel, Monterey, TN (US)

( * ) Notice: Subject to any disclaimer, the term of this patent is extended or adjusted under 35 U.S.C. 154(b) by 503 days.

(21) Appl. No.: 16/785,616

(22) Filed: Feb. 9, 2020

(65) Prior Publication Data

US 2020/0229586 A1 Jul. 23, 2020

Related U.S. Application Data

(63) Continuation of application No. 15/674,399, filed on Aug. 10, 2017, now abandoned.

(51) Int. Cl.

| | |
|---|---|
| ***A46B 15/00*** | (2006.01) |
| ***B65D 41/02*** | (2006.01) |
| ***A46B 9/02*** | (2006.01) |
| ***A46B 11/00*** | (2006.01) |

(52) U.S. Cl.

CPC ..... *A46B 15/0061* (2013.01); *A46B 9/023* (2013.01); *A46B 11/0062* (2013.01); *A46B 11/0065* (2013.01); *B65D 41/02* (2013.01); *A46B 15/0077* (2013.01); *A46B 2200/104* (2013.01)

(58) Field of Classification Search

CPC ..... A46B 9/023; A46B 11/00; A46B 11/001; A46B 11/0062; A46B 15/0055; A46B 15/0061; A46B 15/0067

USPC ..... 132/213; 15/105, 159.1, 160

See application file for complete search history.

(56) References Cited

U.S. PATENT DOCUMENTS

| | | | | |
|---|---|---|---|---|
| 4,448,453 | A * | 5/1984 | Irelan | B60P 3/34 296/156 |
| 6,618,893 | B1 * | 9/2003 | Wang | A46B 3/20 15/186 |
| 7,055,528 | B2 * | 6/2006 | Shah | A45D 24/28 132/109 |
| 10,334,942 | B2 * | 7/2019 | Newton | A47K 7/028 |
| 2008/0149124 | A1 * | 6/2008 | McKay | A61K 47/556 132/120 |
| 2011/0197917 | A1 * | 8/2011 | Koptis | B65D 73/0071 401/270 |
| 2016/0262518 | A1 * | 9/2016 | Guy-Rabi | A45D 20/48 |

* cited by examiner

*Primary Examiner* — Michael D Jennings
*Assistant Examiner* — Aaron R McConnell
(74) *Attorney, Agent, or Firm* — Inventa Capital PLC

(57) ABSTRACT

A hairbrush includes a body having a first half and a second half, and a container therebetween for storing fluids like liquids, i.e., water, alcohol, lotions, creams, etc. The first half and second half include respective bottom parts of a generally rectangular configuration each extending to an elongated portion extending to an open front. The first half and second half include respective inner surfaces and outer surfaces, with the second half including a flexible core from which a plurality of bristles extend radially outwardly.

10 Claims, 3 Drawing Sheets

LIQUID DISPENSING HAIR BRUSH

FIELD OF THE INVENTION

This invention relates generally to hair brushes that allows the user of the hair brush to spray a liquid from the hair brush out from the hair brush and more particularly to hair brushes, which are combined with dispensers of poured liquids or creams.

BACKGROUND OF THE INVENTION

The idea of a combined brush and dispenser has been known for many years. There have been several suggested arrangements for a hair brush combined with a liquid dispenser. Many patents have been issued to dispense hair care products through the bristles of the brush. A liquid dispensing hair brush includes a body having a chamber therein. The hair brush includes a liquid container in the chamber. A trigger is also contained within the chamber. The trigger may be depressed such that it drives the liquid container relative to the body. A pump is disposed in the container that dispenses liquid from the container through a spray nozzle when the container is driven by the trigger. The pump and container are disposed in the head portion of the brush such that the pump stroke may be relatively short. The container may be removable and replaceable or refillable.

Another prior art reference discloses an aerosol can attached to the back of a hair brush with a mechanical linkage for dispensing the material. Still another prior art reference shows a hairbrush and aerosol spray assembly whereby the spray comes out through the bristles of the brush. Most prior art brushes combined with dispensers employ the use of an aerosol spray container or a non-refillable container which must be disposed of after one use, which is bad for the environment.

While the prior art includes a substantial number of brushes with dispensers, none have been found that are easy or economical to manufacture, or which can be used in a variety of forms.

Another object is to provide an economical construction of a combined hairbrush and container with dispenser.

These and other problems have been solved by the improved system and method described below.

SUMMARY OF THE INVENTION

A hairbrush of the present invention includes a body having a first half and a second half and a container for storing fluids like liquids, i.e. water, alcohol, lotions, creams, etc. The first half includes a bottom part of a generally rectangular configuration extending to an elongated portion further extending to an open front. The first half includes an inner surface and an outer surface. The outer surface defines an outer indentation to receive a mirror. Alternatively, the outer surface may be planar with no indentation and the mirror. The inner surface defines an inner indentation to receive the container. The first half includes a peripheral wall extending outwardly from the bottom part and the elongated portion. A plurality of first connectors, i.e. male or female connectors, are formed on the peripheral wall at the bottom part to mechanically engage the second connectors, i.e. male or female connectors, defined in the container. The bottom part of the first half may present a round configuration or any other configurations, without limiting the scope of the present invention.

The second half includes a bottom part of a generally rectangular configuration extending to an elongated portion further extending to an open front. The second half includes an inner surface and an outer surface. The outer surface defines an opening to receive flexible core from which a plurality of bristles extending radially outwardly. The bristles extend substantially entirely from the core. The second half includes a peripheral wall extending outwardly from the bottom part and the elongated portion. A plurality of first connectors, i.e. male or female connectors, are formed on the peripheral wall at the bottom part to mechanically engage the second connectors, i.e. male or female connectors, defined in the container. The bottom part of the first half may present a round configuration or any other configuration, without limiting the scope of the present invention.

The container includes a bottom part of a generally rectangular configuration having flat opposing walls extending to an elongated neck portion extending to an open front defining male connectors to receive respective female connectors define inside a cap to close the container in order to prevent liquids from spilling out. The container presents a peripheral side wall and the plurality of the male or female connectors, are formed on the peripheral side wall to mechanically engage with the male or female connectors, defined in the first half and the second half. When the first half and the second half of the body are connected with one another to hold the container inside the entire hair brush is assembled and is ready to use to brush the hair or used as the container to store and use liquids for various purposes.

An advantage of the present invention is to provide a device that can be used to brush hair and as a contained for storing liquids and using liquids during travel.

Another advantage of the present invention is to provide a brush that is light in weigh and easy to manufacture.

Other advantages and meritorious features of this invention will be more fully understood from the following description of the preferred embodiment, the appended claims, and the drawings, a brief description of which follows.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
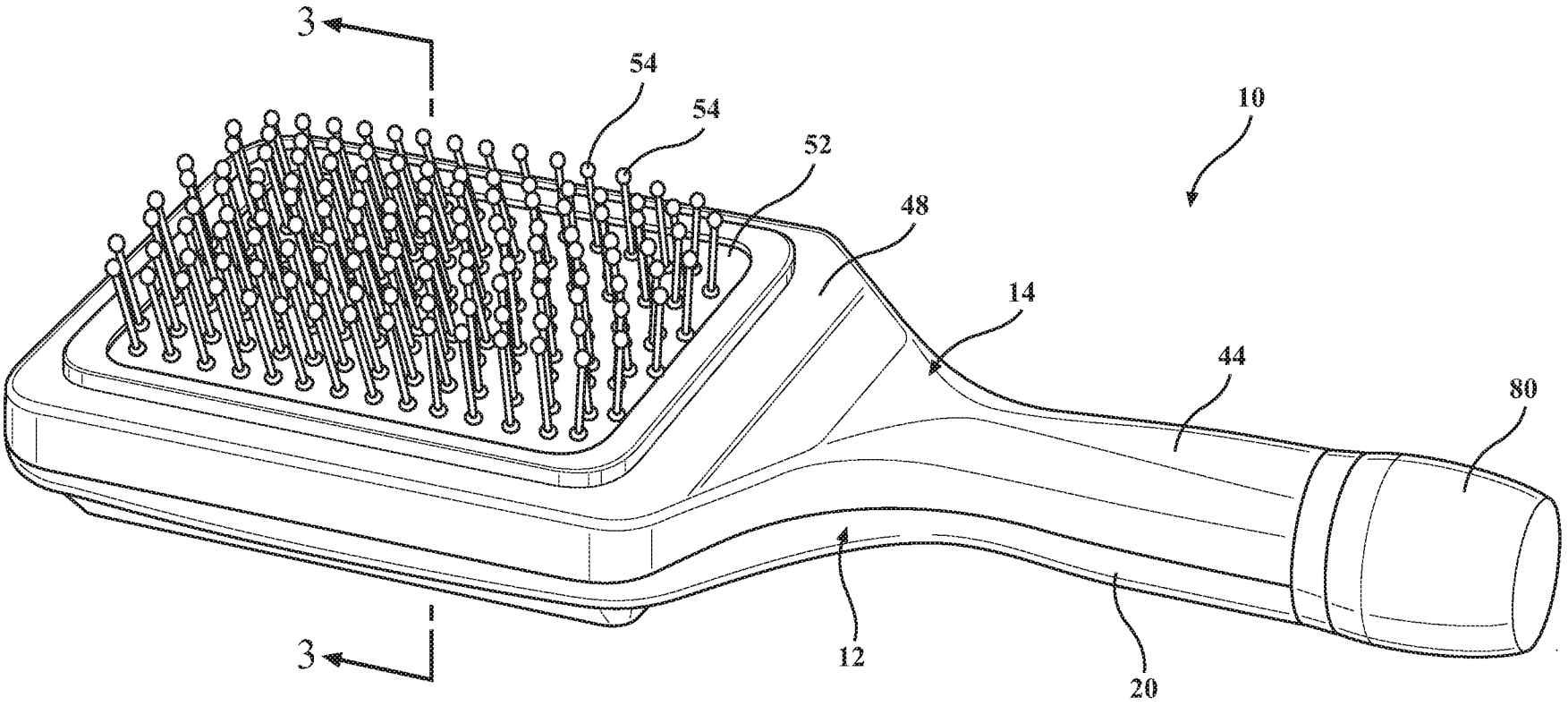
FIG. 1 illustrates a perspective view of a hair brush of the present invention.
Figure 2:
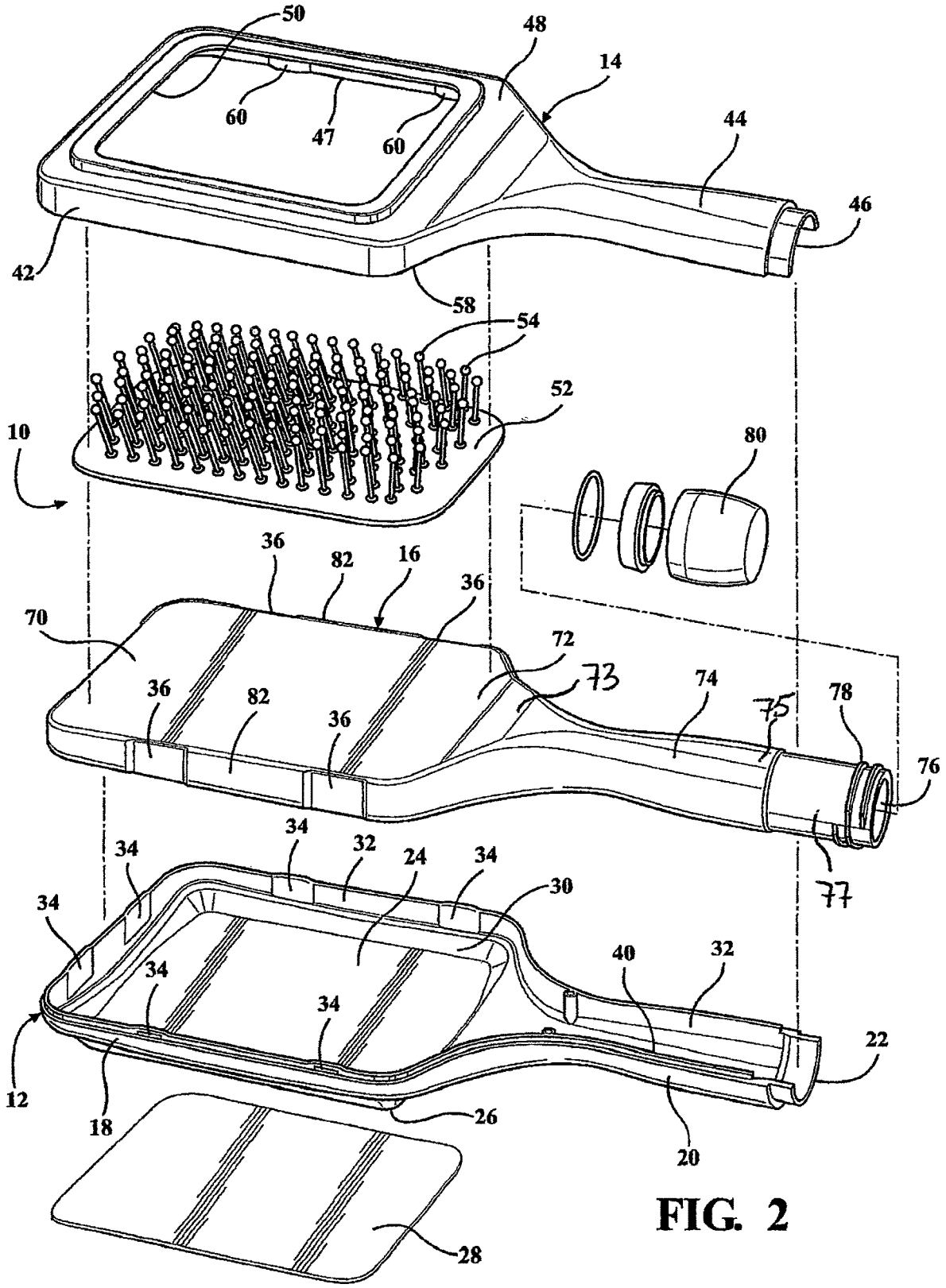
FIG. 2 illustrates an exploded view of an alternative embodiment of the hair brush.
Figure 3:
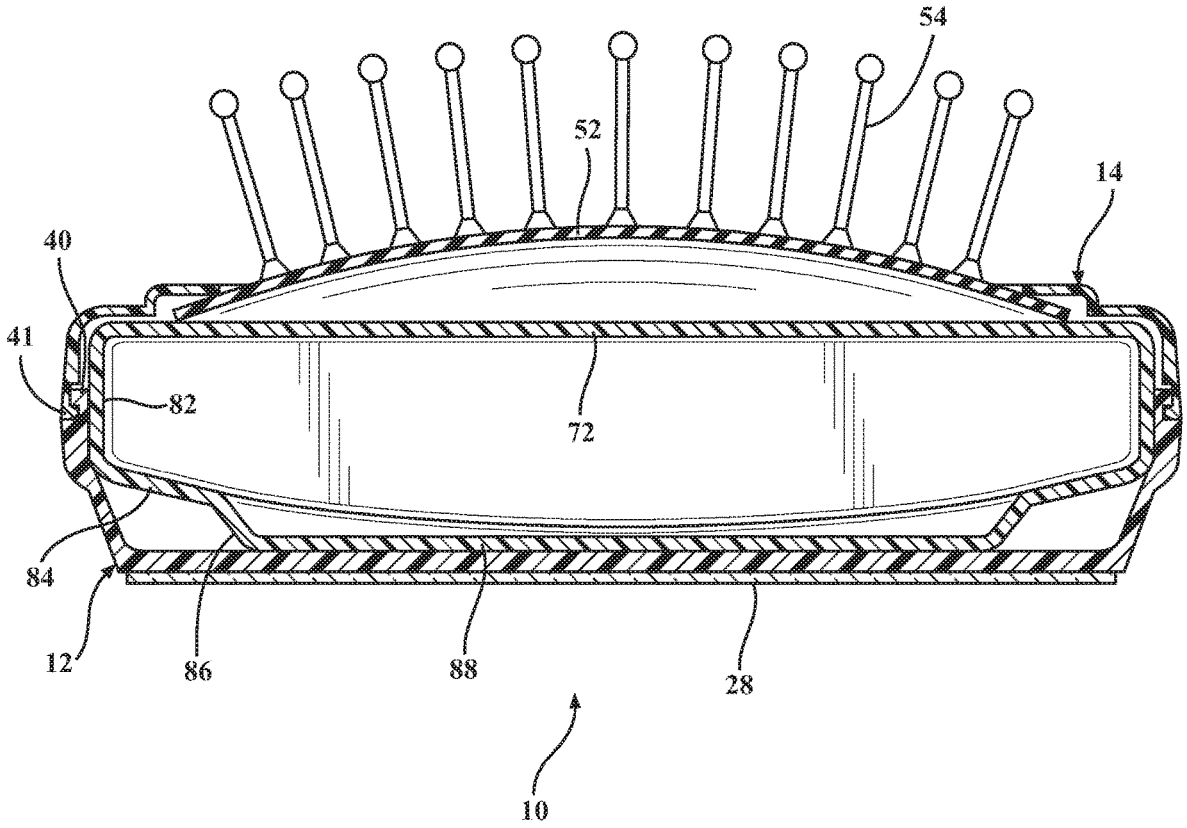
FIG. 3 illustrates a cross sectional view of the hair brush of the present invention taken along line 3-3.

Referring to FIGS. 1 through 3, wherein reference numerals indicate like or similar parts, a hairbrush of the present invention is generally shown at 10 in FIGS. 1-3. The hairbrush 10 includes a body having a first half, generally indicated at 12, and a second half, generally indicated at 14. A container, generally indicated at 16, is used for storing fluids like liquids, i.e. water, alcohol, lotions, creams, etc.

The first half 12 includes a bottom part 18 of a generally rectangular configuration extending to an elongated portion 20. The elongated portion 20 is in fluid communication with the bottom part 18 and has a generally semi-cylindrical configuration and an open end 22, i.e., the elongated portion 20 extends from the bottom part 18 to an open front 22, as shown in FIG. 2. The elongated portion 20 extends from the bottom part 18 a sufficient length to serve as a handle. The bottom part 18 of the first half 12 includes an inner surface 24 and an outer surface 26. The outer surface 26 defines an outer indentation to receive a mirror 28. Alternatively, as best shown in FIG. 1, the outer surface 26 may be planar with no indentation and the mirror. The inner surface 24 defines an inner indentation or a dish 30 to receive the container 16. The first half 12 includes a peripheral wall 32 extending outwardly from and along the periphery of the bottom part 18 and the elongated portion 20.

A plurality of first connectors 34. i.e. male or female connectors, are formed on the peripheral wall 32 at the bottom part 18 to mechanically engage the second connectors 36, i.e. male or female connectors, defined in the container 16. The peripheral wall 32 further extends to a peripheral hook 40. The bottom part 18 of the first half 12 may present a round configuration or any other configurations, without limiting the scope of the present invention.

The second half 14 includes a bottom part 42 of a generally rectangular configuration extending to an elongated portion 44. The elongated portion 44 is in fluid communication with the bottom part 42 and has a generally semi-cylindrical configuration and an open end 46, i.e., the elongated portion 44 extends from the bottom part 42 to an open front 46, as shown in FIG. 2. The elongated portion 44 extends from the bottom part 42 a sufficient length to serve as a handle. The bottom part 42 of the second half 14 includes an inner surface 47 and an outer surface 48. The outer surface 48 defines an opening 50 to receive a flexible core 52 from which a plurality of bristles 54 extend radially outwardly. The bristles 54 extend substantially entirely from the flexible core 52. The second half 14 includes a peripheral wall 58 extending outwardly from and along the periphery of the bottom part 42 and the elongated portion 44.

A plurality of first connectors 60, i.e., male or female connectors, are formed on the peripheral wall 58 of the bottom part 42 to mechanically engage the second connectors 36, defined in the container 16. The peripheral wall 58 further extends to a peripheral hook 41 extending along the peripheral wall 58 to mechanically engage with the peripheral hook 40 extending along the peripheral wall 32, as best shown in FIG. 3. The bottom part 42 of the second half 14 may present a round configuration or any other configuration, without limiting the scope of the present invention.

As best seen in FIG. 2, the container 16 is formed as a hollow unitary member and includes a bottom part 70 and an elongated neck portion 74. The bottom part 70 has a generally rectangular configuration corresponding to the configurations of the bottom parts 18, 42 of the first and second halves 12, 14. The bottom part 70 has a pair of opposing walls 72 separated by a peripheral side wall 82. One of the opposing walls 72 is envisioned to be flat, while the other opposing wall 72 may be curved, shaped, or flat. The bottom part 70 extends to the elongated neck portion 74 that has a substantially cylindrical configuration, aproximal end 73, a distal end 75, and an open-end portion 77 connected to the distal end 75. The open-end portion 77 includes an opening 76. The open-end portion 77 includes male connectors 78 configured to receive respective female connectors defined inside a cap 80 to securely close the container 16 in order to prevent liquids from spilling out. As best shown in FIG. 2, the open-end portion 77 has a diameter that is smaller than a diameter of at least the distal end 75 of the elongated neck portion 74 and configured to receive the cap 80 such that the cap 80 is generally flush with the distal end 75 of the elongated neck portion 74. The elongated neck portion 74, as best seen in FIG. 2, extends from the bottom part 70 a length that is longer than the lengths of the elongated portions 20 and 44 such that, when the container 16 is enclosed by the first and second halves 12, 14, the open-end portion 77 of the elongated neck portion 74 extends and is exposed past the elongated portions 20 and 44. The peripheral side wall 82 includes the plurality of the male or female connectors 36 that are formed on the peripheral side wall 82 to mechanically engage with the male or female connectors of the first half 12 and the second half 14. The container 16, the first half 12 and the second half 14 have substantially identical contour or shape, as best shown in FIG. 2 to allow tight match or fit between the container 16, the first half 12 and the second half 14. Those skilled in the art will appreciate that the first half 12 and the second half 14 may be molded over the container 16.

As best shown in FIG. 3, the container 16 may include one of the opposing walls 72 being planar and the second opposing wall presenting dish like configuration having an outer portion 84 extending further to an inclined wall 86 and further extending to a bottom portion 88 substantially parallel to the opposing wall 72 that is planar. The first half 12 and the second half 14 and the container 16 are formed from polymeric materials, non-polymeric materials, and combination thereof without limiting the scope of the present invention.

As best shown in FIG. 1, when the first half 12 and the second half 14 are connected or interlocked with one another to hold and envelop the container 16 therebetween, such as shown in FIG. 3, the entire hair brush 10 is assembled and is ready to use to brush the hair or to be used as the container to store and use liquids for various purposes.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A hairbrush for brushing hair and storing liquids comprising:

a first half having a first bottom part and a first elongated portion extending therefrom and being in fluid communication with the first bottom part, the first elongated portion having a semi-cylindrical configuration and an open end, the first half including a first peripheral wall extending outwardly from the first bottom part and the first elongated portion;

a second half having a second bottom part and a second elongated portion extending therefrom and being in fluid communication with the second bottom part, the second elongated portion having a semi-cylindrical configuration and an open end, the second half including a second peripheral wall extending outwardly from the second bottom part and the second elongated portion; and a container formed as a unitary hollow member and having a body part and an elongated neck portion extending therefrom, the body part including a pair of opposing walls separated by a peripheral sidewall extending between the opposing walls, wherein a first wall of the pair of opposing walls of the body part of the container is generally flat, wherein a second wall of the pair of opposing walls of the body part of the container is curved, and the peripheral sidewall of the body part is configured to mate via a mechanical connection with the first peripheral wall of the first half and the second peripheral wall of the second half;

wherein the first half and the second half are configured to envelop and mechanically connect with the container therebetween such that the body part of the container is enclosed between the first and second bottom parts of respective first and second halves and the elongated neck portion of the container is enclosed between the first and second elongated portions of the respective first and second halves.

2. The hairbrush as set forth in claim 1, wherein the first bottom part of the first half includes an inner surface and an outer surface, the outer surface is configured to receive a mirror, and wherein the inner surface defines a dish configured to receive the body part of the container.

3. The hairbrush as set forth in claim 1, wherein the first peripheral wall of the first half and the second peripheral wall of the second half each includes one or more connectors configured to mechanically engage the peripheral sidewall of the container.

4. The hairbrush as set forth in claim 1, wherein the first peripheral wall of the first half includes a first peripheral hook extending along the first peripheral wall, wherein the second peripheral wall of the second half includes a second peripheral hook extending along the second peripheral wall, and wherein, when the first half and second half are mated, the first half and second half are configured to mechanically interlock with one another by the first peripheral hook mechanically engaging the second peripheral hook.

5. The hairbrush as set forth in claim 1, wherein the second bottom part of the second half defines an opening therethrough that is configured to receive a flexible core from which a plurality of bristles extend radially outwardly.

6. The hairbrush as set forth in claim 1, wherein the elongated neck portion of the container has a substantially cylindrical configuration and includes a proximal end connected to the body part of the container and a distal end, and wherein the distal end includes an open-end portion extending therefrom and including an opening.

7. The hairbrush as set forth in claim 6, wherein a diameter of the open-end portion is smaller than a diameter of the distal end of the elongated neck portion and includes a male connector configured to engage a female connector inside a cap that closes the opening of the open-end portion.

8. The hairbrush as set forth in claim 2, wherein the second wall of the pair of opposing walls is received in the dish of the first bottom part of the first half.

9. The hairbrush as set forth in claim 1, wherein the elongated neck portion of the container has a length that is longer than a length of the first and second elongated portions of respective one of the first half and second half such that, when the first and second halves are mated, the elongated neck portion extends past the first and second elongated portions.

10. A hairbrush for brushing hair and storing liquids comprising:

a first half having a first bottom part and a first elongated portion extending therefrom and being in fluid communication with the first bottom part, the first elongated portion having a semi-cylindrical configuration and an open end, wherein the first half includes a first peripheral wall extending outwardly from the first bottom part and the first elongated portion, and wherein the first peripheral wall includes a first peripheral hook extending along the first peripheral wall;

a second half having a second bottom part and a second elongated portion extending therefrom and being in fluid communication with the second bottom part, the second elongated portion having a semi-cylindrical configuration and an open end, wherein the second half includes a second peripheral wall extending outwardly from the second bottom part and the second elongated portion, and wherein the second peripheral wall includes a second peripheral hook extending along the second peripheral wall; and a container formed as a unitary hollow member and having a body part and an elongated neck portion extending therefrom, the body part including a pair of opposing walls separated by a peripheral sidewall extending between the opposing walls, the peripheral sidewall of the body part is configured to mate via a mechanical connection with the first peripheral wall of the first half and the second peripheral wall of the second half;

wherein, when the first half and second half are mated, the first half and second half are configured to mechanically interlock with one another by the first peripheral hook mechanically engaging the second peripheral hook; and wherein, when the first half and second half are mated, the first and second halves are configured to envelop the container therebetween such that the body part of the container is enclosed between the first and, second bottom parts and the elongated neck portion is enclosed between the first and second elongated portions.

* * * * *